US005860838A

United States Patent [19]

Kaneko

[11] Patent Number: 5,860,838

[45] Date of Patent: Jan. 19, 1999

[54] TANGLE-PREVENTIVE MECHANISM IN THREE CONTACT PIECES TYPE CONTACT

[75] Inventor: Tetsuya Kaneko, Chiba-ken, Japan

[73] Assignee: Yamaichi Electronics Co., Ltd., Tokyo, Japan

[21] Appl. No.: 787,266

[22] Filed: Jan. 24, 1997

[30] Foreign Application Priority Data

Jan. 26, 1996 [JP] Japan ..... 8-032896

[51] Int. Cl.[6] ..... H01R 13/11

[52] U.S. Cl. ..... 439/857

[58] Field of Search ..... 439/342, 851, 439/861, 856, 857

[56] References Cited

U.S. PATENT DOCUMENTS

| | | | |
|---|---|---|---|
| 2,166,897 | 7/1939 | Wagstaff | 439/857 |
| 3,155,449 | 11/1964 | Henschen | 439/857 |
| 5,213,530 | 5/1993 | Dratsuji | 439/342 |
| 5,299,950 | 4/1994 | Kaneko | 439/342 |
| 5,458,513 | 10/1995 | Matsuoka | 439/857 |

FOREIGN PATENT DOCUMENTS 6-75417 9/1994 Japan .

*Primary Examiner*—Paula Bradley
*Assistant Examiner*—Tho D. Ta
*Attorney, Agent, or Firm*—Wenderoth, Lind & Ponack, L.L.P.

[57] ABSTRACT

A three contact pieces type contact comprises first and second contact pieces facing each other and adapted to clamp a lead pin of an IC, and a third contact piece disposed between the first and second contact pieces at one side thereof such that the third contact piece can contact one side of the lead pin. A tangle-preventive mechanism is provided in the three contact pieces type contact and includes a pair of tangle-preventive pieces formed on opposite sides of the third contact piece and projecting into slits formed between the first contact piece and the third contact piece and between the second contact piece and the third contact piece so that no other contacts enter the slits.

6 Claims, 5 Drawing Sheets

TANGLE-PREVENTIVE MECHANISM IN THREE CONTACT PIECES TYPE CONTACT

BACKGROUND OF THE INVENTION

1. Field of the Invention

This invention relates to a tangle-preventive mechanism in a three contact pieces type contact suited to be used for a socket such as a PGA type IC.

2. Brief Description of the Drawings

The PGA type IC has a plurality of lead pins projecting downwardly from a lower surface of a thin IC body. Widely used as contacts on the socket side to be contacted with such lead pins are three contact pieces type contacts as typically disclosed by Japanese Patent Publication No. 75417/1994.

Each contact has a first contact piece and a second contact piece disposed opposite to each other, and a third contact piece disposed between the first and second contact pieces at one side thereof. The lead pin is inserted between the first and second contact pieces from the other side. By laterally moving the lead pin towards the third contact pin from the insert position, the pin is resiliently clamped between the first and second contact pieces with one side of the lead pin allowed to contact the third contact piece. The third contact piece acts as means for increasing a contact surface. In addition, the third contact piece serves to prevent the lead pin from overly laterally moving and help the first and second contact pieces clamp the lead pin.

However, the above contact has the following shortcomings. Since the first, second and third contact pieces are arranged in a generally U-shaped construction in plan view, a slits is formed between the first contact piece and the third contact piece and a slits is formed between the second contact piece and the third contact piece, and component parts of other contacts tend to enter the slits. Particularly, when male terminals of other contacts to be connected to a wiring board enter the slits, tangling can occur and the male terminals can be deformed. This is apparently inconvenient when the contact is automatically implanted in a socket board. As a consequence, yield of the contact itself or the socket with the contact implanted therein is degraded.

The present invention has been accomplished in view of the above situation.

SUMMARY OF THE INVENTION

It is, therefore, an object of the present invention to provide a tangle-preventive mechanism in a three contact pieces type contact capable of efficiently improving the above shortcomings.

In order to achieve the above object, there is essentially provided a tangle-preventive mechanism in a three contact pieces type contact comprising first and second contact pieces facing each other and adapted to clamp a lead pin of an IC, and a third contact piece disposed between the first and second contact pieces at one side thereof such that the third contact piece can contact one side of the lead pin. The tangle-preventive mechanism in the three contact pieces type contact comprises a pair of tangle-preventive pieces formed on opposite sides of the third contact piece and projecting into slits formed between the first contact piece and the third contact piece and between the second contact piece and the third contact piece so that no other contacts enter the slits.

It is preferred that the third contact piece includes a pair of press-in claw pieces formed on the opposite sides thereof at areas adjacent the slits and projecting beyond backs of the first and second contact pieces.

Other objects and advantages of the present invention will become more apparent during the course of the following description when taken in connection with the accompanying drawings.

DETAILED DESCRIPTION OF THE INVENTION

Figure 1:
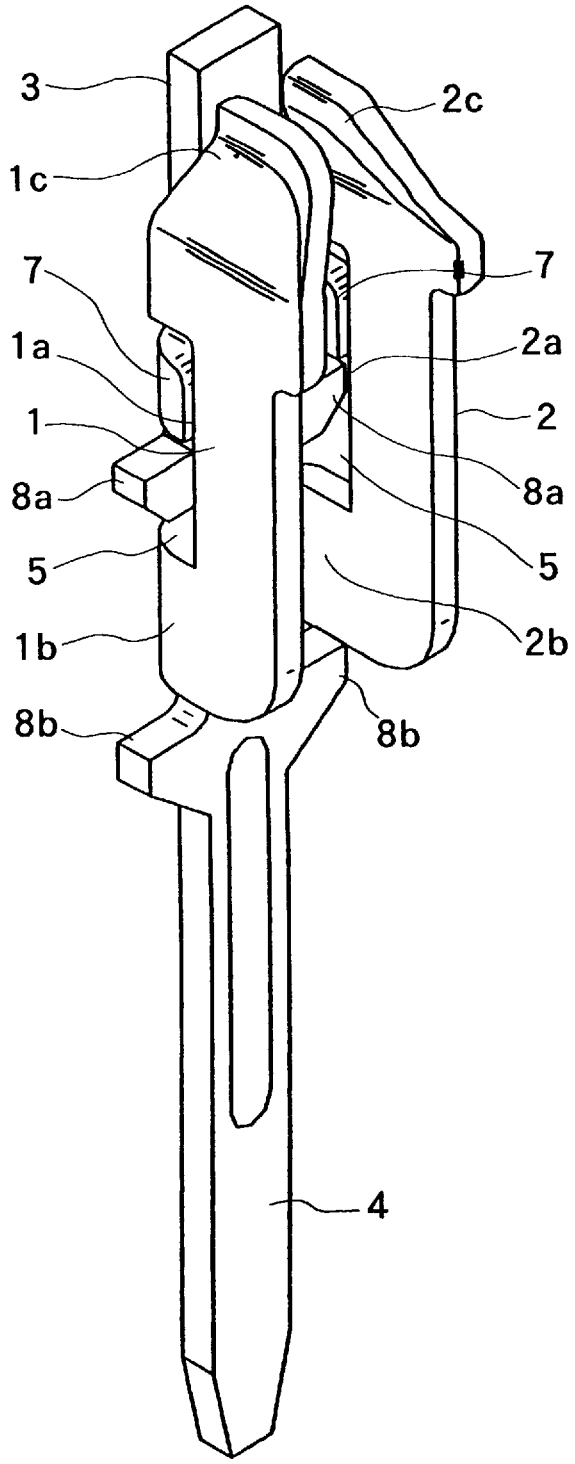
FIG. 1 is a perspective view of a three contact pieces type contact when viewed from its front side.

The present invention will now be described with reference to FIGS. 1 through 5 of the accompanying drawings.

As shown in FIGS. 1 through 4, a contact includes a first contact piece 1, a second contact piece 2 and a third contact piece 3. The first and second contact pieces 1 and 2 are disposed opposite to each other. The third contact piece 3 is disposed between the first and second contact pieces at one side thereof Thus, the contact has a generally U-shaped configuration in a plan view.

On the other hand, a PGA type IC has a flat and square IC body with a plurality of lead pins 6 projecting from a lower surface thereof. Each lead pin 6 is to be resiliently clamped between the first contact piece 1 and the second contact piece 2, and the third contact piece supplements this contact.

Figure 5A:
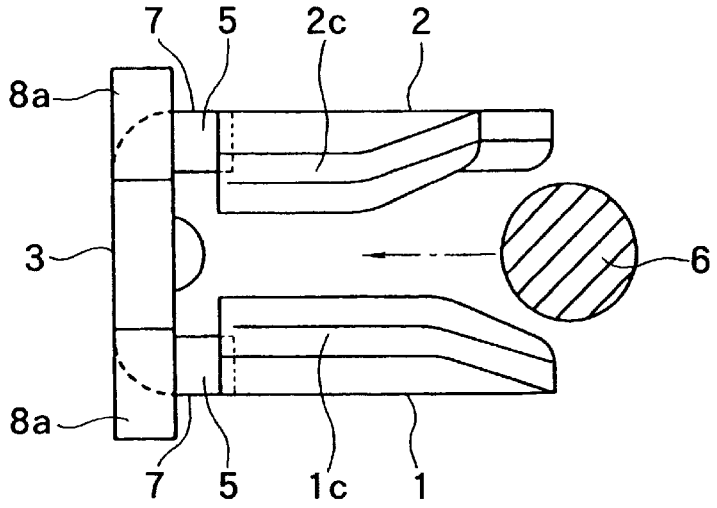
FIGS. 5(A) through 5(C) are plan views, showing a lead pin shown in section gradually contacting the three contact pieces type contact.
Figure 5B:
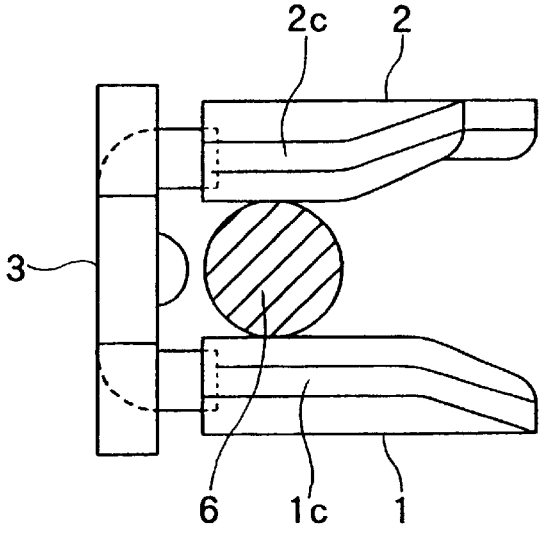
Figure 5C:
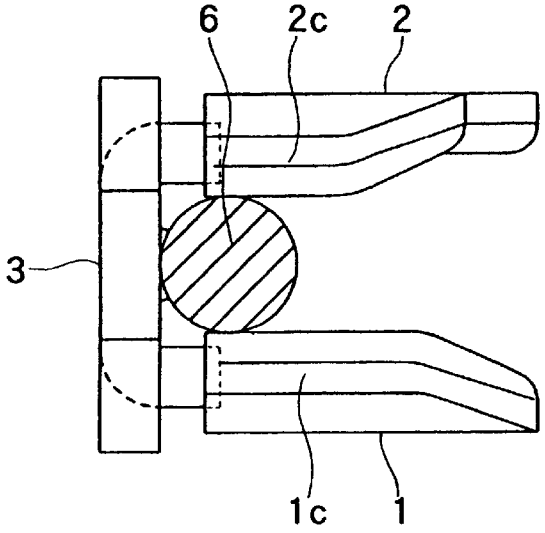

More specifically, as shown in FIG. 5(A), the lead pin 6 is inserted into an insert position between the first contact piece 1 and the second contact piece 2 at one side thereof, and then, as shown in FIG. 5(B), the lead pin 6 is laterally moved into between the first contact piece 1 and the second contact piece 2 from the insert position and resiliently clamped therebetween. Thereafter, as shown in FIG. 5(C), the laterally moved lead pin 6 is brought into contact with the third contact piece 3 while being clamped between the first contact piece and the second contact piece.

The contact is formed by blanking and bending a metal band material. The first and second contact pieces 1 and 2 are disposed in a vertical direction their blanked plate surfaces facing with each other. The third contact piece 3 is also disposed in a vertical direction with its blanked plate surface facing towards the first and second contact pieces 1 and 2.

Accordingly, the first, second and third contact pieces 1, 2 and 3 are oriented such that their banked plate surfaces form a U-shaped configuration in a plan view. A pair of vertically extending slits 5 are formed between adjacent edge portions 1*a* and 3*a* of the first and third contact pieces 1 and 3, and between adjacent edge portions 2*a* and 3*a* of the second and third contact pieces 2 and 3.

The first, second and third contact pieces 1, 2 and 3 are integrally blanked and bent such that their basal portions are connected to opposite adjacent edge portions 3*a* of the third contact piece 3. A male terminal 4, extending from connection portions between the first contact piece 1 and the third contact piece 3 and between the second contact piece 2 and the third contact piece 3 so as to be inserted into a through-hole of the wiring board for connection, is also formed by integrally banking. By this, a unit contact is formed.

The first and second contact pieces 1 and 2 are connected to the third contact piece 3 through a pair of protrusions 1*b* and 2*b* protruding from a basal portion of the adjacent edge portion 3*a* of the third contact piece 3 and extend in a vertical direction with a predetermined very small space formed between the first contact piece 1 and the third contact piece 3 and between the second contact piece 2 and the third contact piece 3. The pair of slits 5 extend upwardly from the connection portions between the adjacent edge portions 1*a* and 3*a* of the first and third contact pieces 1 and 3 and between the adjacent edge portions 2*a* and 3*a* of the second and third contact pieces 2 and 3. The slits 5 are terminated and closed at the connection portions and open at the upper end.

A pair of tangle-preventive pieces 7 project into the slits 5. The tangle-preventive pieces 7 project towards the blanked and sheared surfaces of the first and second contact pieces 1 and 2 from the adjacent edge portions of the third contact piece 3 with respect to the first and second contact pieces 1 and 2, thereby limiting the opening widths of the slits 5 so that entry of other contacts into the slits 5 can effectively be prevented.

As described above, the first, second and third contact pieces 1, 2 and 3, and the male terminal 4 are elongated and have free ends respectively. Each of those contact component elements 1 through 4, for example, the male terminal 4 has a possibility to enter the other contact slit 5. The dimension of each slit 5 is determined by a relative arrangement between the first and second contact pieces 1 and 2 and the third contact piece 3, and also by lateral plate widths of the first and second contact pieces 1 and 2. Thus, the dimension of each slit 5 can be designed in various ways.

Figure 4D:
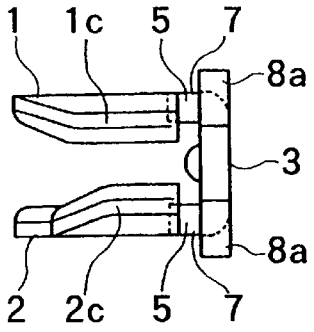
FIG. 4(D) is a plan view of the contact of FIG. 1
Figure 4E:
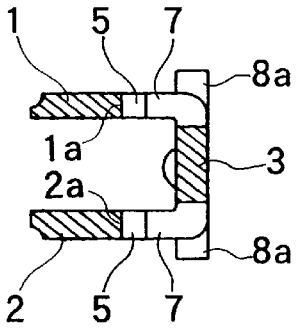
FIG. 4(E) is a sectional view taken on line 4(E)—4(E) of FIG. 4(B)
Figure 4A:
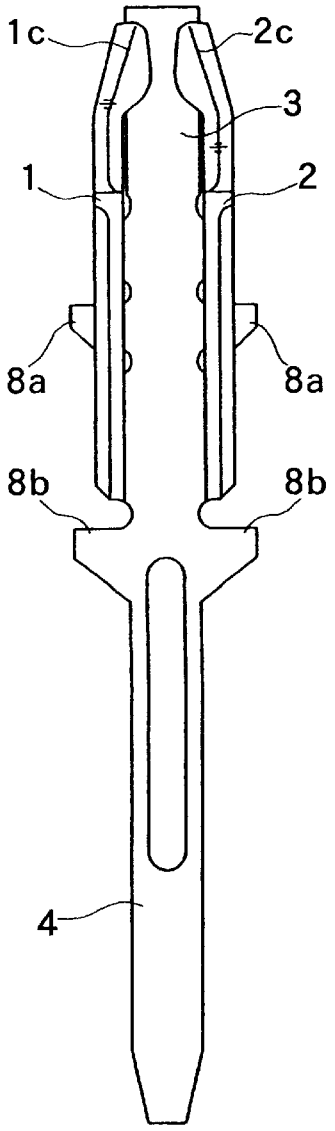
FIG. 4(A) is a front view of the contact of FIG. 1.
Figure 4B:
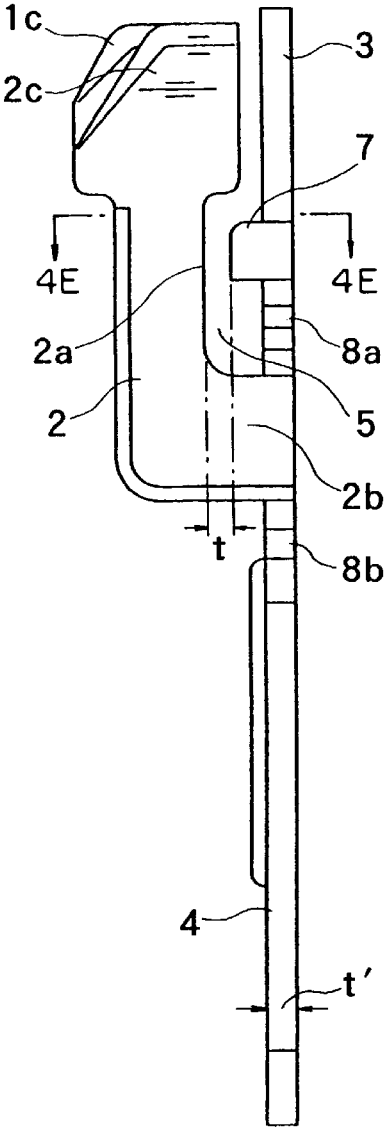
FIG. 4(B) is a side view of the contact of FIG. 1.

A projecting amount of each tangle-preventive piece 7 is set in accordance with the size of each slit 5. As shown in FIG. 4(B), a dimension t at the projecting part of the slit 5' is set equal to or smaller than a plate thickness t' of the male terminal 4, for example. That is, it is preferred that the equation $t' \geqq t$ is satisfied. In other words, the projecting amount of each tangle-preventive piece 7 is determined such that the dimension t at the projecting part of the slit 5' is equal to or smaller than the thickness of the metal bank plate material which is to be subjected to contact blanking.

Preferably, the tangle-preventive pieces 7 are disposed in symmetrical locations of the opposite adjacent edge portions of the third contact piece 3, in other words, at locations generally equal in height to the opposite adjacent edge portions of the third contact piece 3.

In this embodiment, as apparent from FIG. 1 and FIG. 4(B), the lateral dimensions of the clamping pieces 1*c* and 2*c* of the upper ends of the first and second contact pieces 1 and 2 are wider than the remaining parts of the contact pieces, so that the lead pin 6 can be smoothly moved and securely clamped therebetween. Those parts (remaining parts) of the contact pieces excluding the clamping pieces 1*c* and 2*c* are dimensioned such that appropriate spring pressure can be obtained. As a consequence, the slits 5 each having a larger width dimension can be formed at the extending parts of the first and second contact pieces 1 and 2 excluding the clamping pieces 1*c* and 2*c*.

Although the provision of the clamping pieces 1*c* and 2*c* makes it more difficult to allow other contact parts to entered into the slits 5 to escape therefrom, the tangle-preventive pieces 7 can effectively serve to solve such a problem of mutual tangling of the contacts in such a contact structure.

The contact is provided with press-in claw pieces 8*a* and 8*b* for use in press fitting the contact into a planting hole formed in the socket body made of an insulative material.

Figure 2:
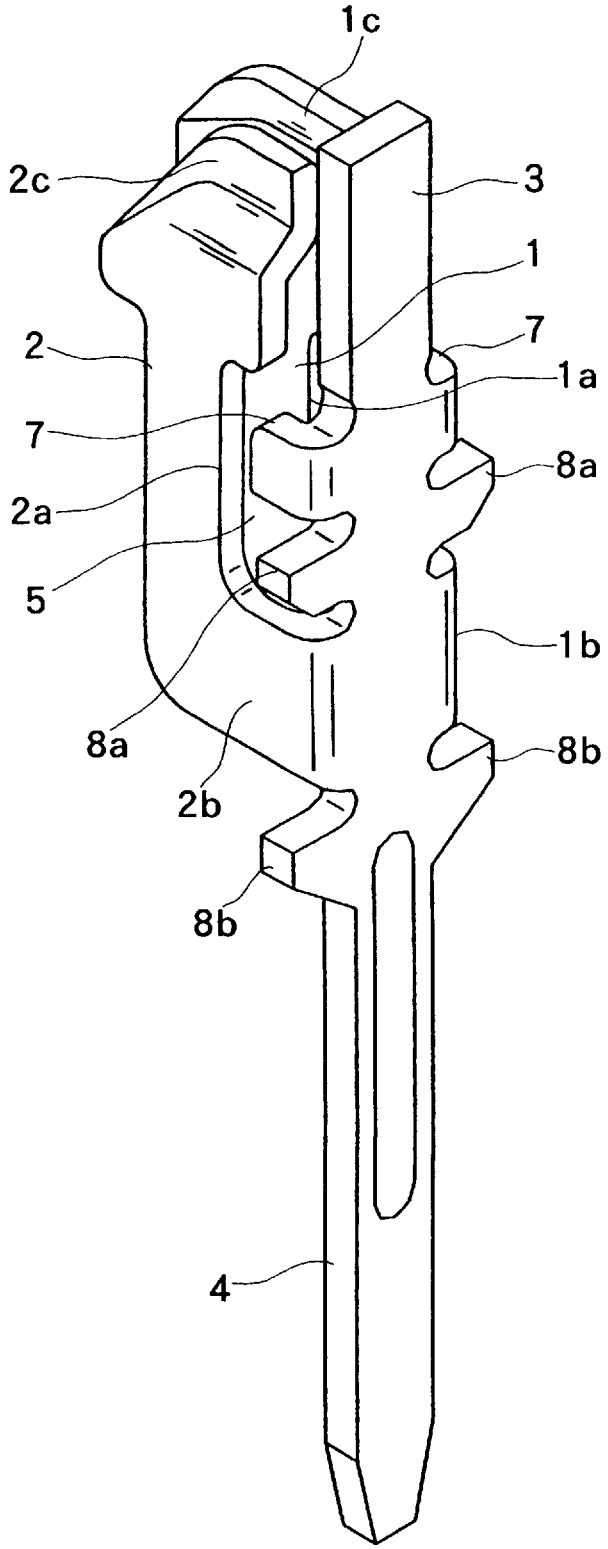
FIG. 2 is a perspective view of the above three contact pieces type contact when viewed form its back side.
Figure 3:
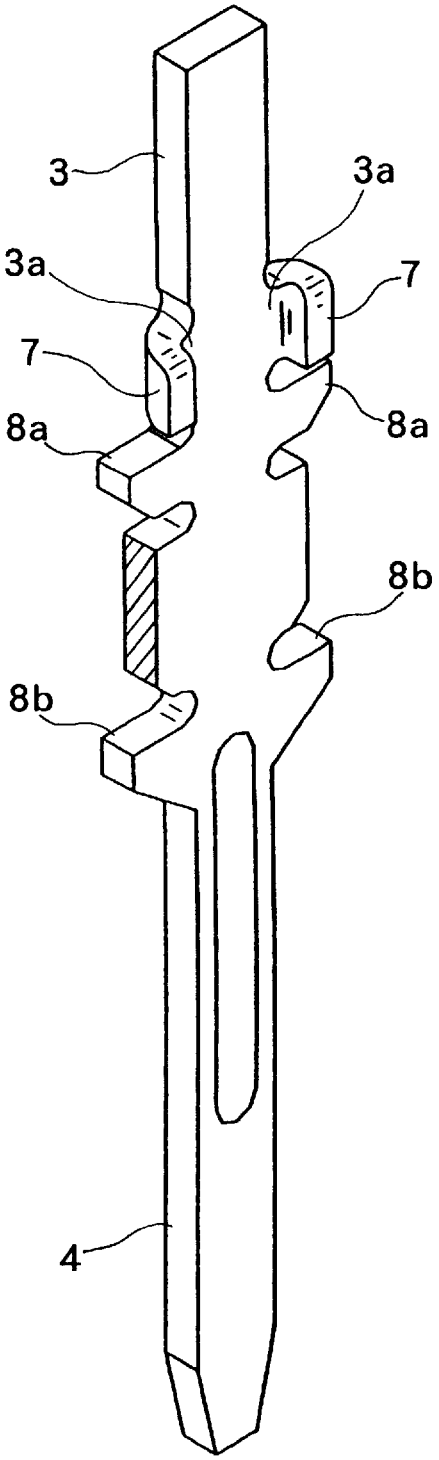
FIG. 3 is a perspective view showing a third contact piece (namely, the above three contact pieces type contact) with first and second contact pieces thereof removed.
Figure 4C:
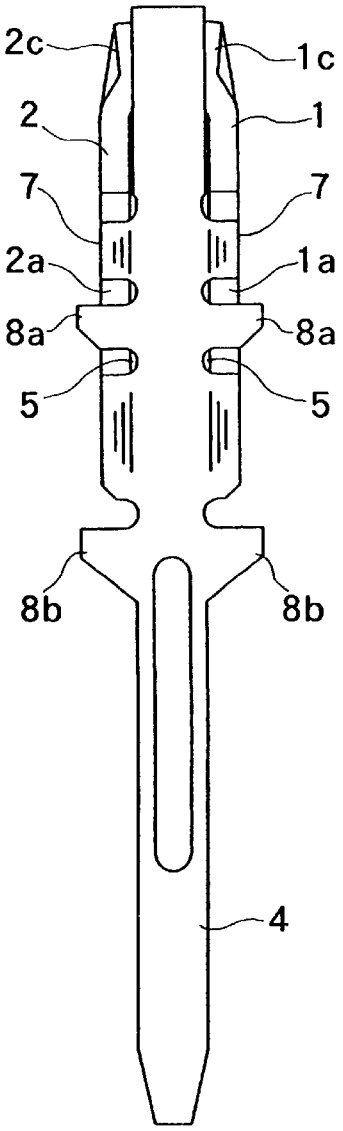
FIG. 4(C) is a rear view of the contact of FIG. 1.

In the embodiment, as apparent from FIGS. 2 and 4(C), the press-in claw pieces 8*a* symmetrically project sidewardly from the opposite adjacent edge portions 3*a* of the third contact piece 3 at locations where the slits 5 extend and are arranged immediately under the tangle-preventive pieces 7. The other press-in claw pieces 8*b* symmetrically project sidewardly from the opposite side portions of the basal portion of the male terminal 3. The press-in claw pieces 8*a* serve to prevent the component elements of other contacts from entering the slits 5 from the back side of the third contact piece 3 and co-act with the tangle-preventive pieces 7 to enhance the tangle-preventive effect.

The present invention is useful not only for the case where the lead pin 6 contacts the third contact piece 3 as shown in FIG. 5(C) but also the case where the final lateral movement position of the lead pin 6 is the position of FIG. 5(B) and the lead pin 6 does not contact the third contact piece 3.

According to the present invention, other contacts can effectively be prevented from entering the slits formed between the first contact piece and the third contact piece and between the second contact piece and the third contact piece in a three contact pieces type contact, the three contact pieces type contacts are prevented from being mutually tangled and therefore not disturbed from being automatically implanted into the socket board, and the contact is not deformed.

The above problems can easily be obviated merely by setting the projecting dimensions of the tangle-preventive pieces 7 in accordance with the width dimensions of the slits 5. Therefore, a simple construction of the three contact pieces type contact can be obtained.

While one preferred embodiment of a tangle-preventive mechanism in a three contact pieces type contact according to the present invention has thus far been described with reference to the drawings, it should be borne in mind that such an embodiment is merely illustrative of the gist of the present invention and is accordingly subject to modification and change.

What is claimed is:

1. A contact comprising:

an elongated male terminal having a given width and a given thickness;

first, second and third elongated contact pieces connected to said male terminal;

wherein said first and second contact pieces face each other and are adapted to clamp a lead pin of an IC therebetween, each of said first and second contact pieces having a first side edge facing generally in a first direction and a second side edge facing generally in a second direction opposite said first direction;

wherein said third contact piece is disposed between said first and second contact pieces such that a first slit is formed between said second side edge of said first contact piece and a first side edge of said third contact piece, and a second slit is formed between said second side edge of said second contact piece and a second side edge of said third contact piece;

wherein a first tangle-preventive piece is provided and has a base end connected to said first side edge of said third contact piece, and a free distal end projecting into said first slit formed between said second side edge of said first contact piece and said first side edge of said third contact piece, such that a distal end face of said first tangle-preventive piece faces said second side edge of said first contact piece, and such that a first space is formed between said distal end face of said first tangle-preventive piece and said second side edge of said first contact piece;

wherein a second tangle-preventive piece is provided and has a base end connected to said second side edge of said third contact piece, and a free distal end projecting into said second slit formed between said second side edge of said second contact piece and said second side edge of said third contact piece, such that a distal end face of said second tangle-preventive piece faces said second side edge of said second contact piece, and such that a second space is formed between said distal end face of said second tangle-preventive piece and said second side edge of said second contact piece; and wherein each of said first and second spaces is no larger than said given width and said given thickness of said male terminal.

2. A contact as recited in claim 1, wherein a first portion of said first tangle-preventive piece adjacent said base end thereof extends generally in said third direction, and a second portion of said first tangle-preventive piece adjacent said distal end thereof extends generally in said first direction; and a first portion of said second tangle-preventive piece adjacent said base end thereof extends generally in said fourth direction, and a second portion of said second tangle-preventive piece adjacent said distal end thereof extends generally in said first direction.

3. A contact as recited in claim 1, further comprising a first press-in claw piece projecting into said first slit from said first side edge of said third contact piece in a third direction generally orthogonal to said first and second directions; and a second press-in claw piece projecting into said second slit from said second side edge of said third contact piece in a fourth direction generally opposite said third direction and generally orthogonal to said first and second directions.

4. A contact as recited in claim 3, wherein a first portion of said first tangle-preventive piece adjacent said base end thereof extends generally in said third direction, and a second portion of said first tangle-preventive piece adjacent said distal end thereof extends generally in said first direction; and a first portion of said second tangle-preventive piece adjacent said base end thereof extends generally in said fourth direction, and a second portion of said second tangle-preventive piece adjacent said distal end thereof extends generally in said first direction.

5. A contact as recited in claim 3, wherein said first and second press-in claw pieces are disposed adjacently below said first and second tangle-preventive pieces, respectively, with respect to a longitudinal direction of said third contact piece.

6. A contact as recited in claim 5, wherein a first portion of said first tangle-preventive piece adjacent said base end thereof extends generally in said third direction, and a second portion of said first tangle-preventive piece adjacent said distal end thereof extends generally in said first direction; and a first portion of said second tangle-preventive piece adjacent said base end thereof extends generally in said fourth direction, and a second portion of said second tangle-preventive piece adjacent said distal end thereof extends generally in said first direction.

* * * * *